US008857936B2

(12) United States Patent
Furuno

(10) Patent No.: US 8,857,936 B2
(45) Date of Patent: Oct. 14, 2014

(54) INK-JET RECORDING APPARATUS

(71) Applicant: Kumiko Furuno, Kokubunji (JP)

(72) Inventor: Kumiko Furuno, Kokubunji (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 0 days.

(21) Appl. No.: 13/794,575

(22) Filed: Mar. 11, 2013

(65) Prior Publication Data

US 2013/0241985 A1 Sep. 19, 2013

(30) Foreign Application Priority Data

Mar. 14, 2012 (JP) ..... 2012-058003

(51) Int. Cl.
*B41J 29/38* (2006.01)
*B41J 2/045* (2006.01)

(52) U.S. Cl.
CPC ..... *B41J 2/04541* (2013.01); *B41J 2/04593* (2013.01); *B41J 2/04588* (2013.01); *B41J 2/04581* (2013.01); *B41J 2/04591* (2013.01)
USPC ..... 347/11; 347/69

(58) Field of Classification Search
CPC ..... B41J 2/14209
USPC ..... 347/11
See application file for complete search history.

(56) References Cited

U.S. PATENT DOCUMENTS

| | | | | |
|---|---|---|---|---|
| 6,141,113 | A * | 10/2000 | Takahashi | 347/11 |
| 6,663,212 | B2 | 12/2003 | Kojima | |
| 2003/0067500 | A1* | 4/2003 | Fujimura et al. | 347/11 |
| 2005/0088468 | A1* | 4/2005 | Clark | 347/11 |
| 2006/0284913 | A1* | 12/2006 | Takanose et al. | 347/15 |
| 2009/0073207 | A1* | 3/2009 | Takeuchi | 347/11 |
| 2009/0141058 | A1* | 6/2009 | Uraki | 347/11 |
| 2011/0261101 | A1* | 10/2011 | Drury et al. | 347/12 |

FOREIGN PATENT DOCUMENTS

| | | | |
|---|---|---|---|
| JP | 2002-086766 | A | 3/2002 |
| JP | 2002-321360 | A | 11/2002 |

* cited by examiner

*Primary Examiner* — Shelby Fidler
(74) *Attorney, Agent, or Firm* — Holtz Holtz Goodman & Chick PC

(57) ABSTRACT

A drive signal generating unit that generates a drive signal applying, in one pixel period, at least one drive waveform for causing ink droplets to be discharged can generate two types of drive waveforms, a large droplet waveform and a small droplet waveform. The large droplet waveform includes an expansion pulse expanding the volumes of pressure chambers and a contraction pulse making the volumes of the pressure chambers contract. The expansion pulse width of the large droplet waveform is 2.8 AL or longer but 3.4 AL or shorter. The small droplet waveform includes an expansion pulse, a pause period, and a contraction pulse, and the expansion pulse width of the small droplet waveform is 0.8 AL or longer but 1.2 AL or shorter, where AL represents a half of an acoustic resonance period of a pressure wave in the pressure chamber.

7 Claims, 13 Drawing Sheets

(a)

(b)

INK-JET RECORDING APPARATUS

TECHNICAL FIELD

The present invention relates to an ink-jet recording apparatus, more particularly, to an ink-jet recording apparatus that can discharge, out of a common nozzle, a large droplet and a small droplet whose droplet speeds are nearly equal.

BACKGROUND

An ink-jet recording apparatus that records an image by using an ink-jet recording head (hereinafter referred to as a recording head) discharging a minuscule ink droplet out of a nozzle causes an ink droplet to be discharged out of the nozzle by applying pressure to the ink in a pressure chamber and makes the ink droplet land on a recording medium such as recording paper.

Such an ink-jet recording method makes it possible to perform high-precision image recording with a relatively simple configuration and has rapidly evolved in a wide range of fields from a field for domestic use to a field for industrial use. In particular, various improvements in the enhancement of the speed and image quality of ink-jet recording have been proposed. While there is a strong demand for high-speed printing by the recording head, such as one-pass printing using a line head, there is also a demand for higher image quality by the enhancement of the reproducibility of gradations of a print image.

In the past, to enhance the reproducibility of gradations while performing high-speed printing, a method by which a plurality of ink droplets are discharged out of one nozzle per pixel has been adopted. However, when a plurality of ink droplets are allowed to be continuously discharged out of one nozzle, a longer printing time is required. When the pause period between the drive waveforms for each discharge of droplets is shortened to shorten the printing time, the discharge of ink droplets becomes unstable.

On the other hand, a method of enhancing the reproducibility of gradations of a print image by discharging a large droplet and a small droplet in one pixel has also been known. (for example, refer to JP-A-2002-86766 and JP-A-2002-321360)

In the method of discharging a large droplet and a small droplet, since different droplet sizes of the large droplet and the small droplet result in different sensitivity of the discharged droplet speed to a drive voltage, when the same power source is used, a difference in droplet speed is caused, resulting in displacements of the position in which an ink droplet lands. To address this problem, technologies disclosed in JP-A-2002-86766 delays the discharge timing as the droplet size (the amount of droplet) becomes large (as the droplet speed becomes faster) to prevent displacements of the position in which an ink droplet lands, the displacements caused by a difference in droplet speed between the ink droplets of different sizes, that is, the large ink droplet and the small ink droplet.

Moreover, technologies disclosed in JP-A-2002-321360 outputs a drive waveform by which an ink droplet with a medium volume is discharged before outputting a drive waveform by which an ink droplet with the largest volume is discharged and outputs a drive waveform by which an ink droplet with the smallest volume is discharged before outputting the above drive waveforms to prevent displacements of the position in which an ink droplet lands even when ink droplets of different droplet sizes are discharged.

The techniques of JP-A-2002-86766 and JP-A-2002-321360 are based on the premise that ink droplets of different droplet sizes differ in droplet speed and propose a method of adjusting the discharge timing for each droplet size to prevent displacements of the position in which an ink droplet lands. However, with this method, the drive period becomes undesirably longer due to a delay in the discharge timing, which presents a great problem in performing high-speed printing.

On the other hand, a method of making the droplet speeds of ink droplets of different droplet sizes uniform by varying the drive voltage at which the ink droplets of different droplet sizes are discharged is also adopted. However, this method makes a drive signal generating circuit complicated and increases costs.

Through an intensive study of different droplet speeds due to a difference in droplet size, the inventor of the present invention has found out that, by adjusting the pulse width of the drive waveform for a large droplet and the pulse width of the drive waveform for a small droplet, it is possible to make the droplet speeds nearly equal while allowing the large and small droplets to have different droplet sizes by using the same power source, and has made the present invention.

SUMMARY OF THE INVENTION

The present invention has been made in view of the aforementioned problems. The object of the present invention is to provide an ink-jet recording apparatus that can discharge, out of the same nozzle, a large droplet and a small droplet whose droplet speeds are nearly equal by setting the pulse width of the drive waveform for the large droplet and the pulse width of the drive waveform for the small droplet.

To achieve the abovementioned object, an inkjet recording apparatus reflecting one aspect of the present invention are:

An ink-jet recording apparatus comprising: a recording head that includes a plurality of nozzles discharging ink droplets, pressure chambers, each of the pressure chamber communicating with the nozzles, respectively, and a pressure generating unit causing ink in each of the pressure chambers to be discharged out of the nozzles by varying the volumes of the pressure chambers, respectively; and a drive signal generating unit that generates a drive signal applying, in one pixel period, at least one drive waveform for causing the ink droplets to be discharged, wherein the ink-jet recording apparatus is configured to operate the pressure generating unit by applying the drive signal to the pressure generating unit to make the pressure generating unit cause the ink droplets to be discharged out of the nozzles, wherein the drive signal generating unit is configured to be capable of generating a large droplet waveform and a small droplet waveform, the large droplet waveform includes an expansion pulse to expand the volumes of the pressure chambers and a contraction pulse to contract the volumes of the pressure chambers, and, the expansion pulse width of the large droplet waveform is 2.8 AL or longer but 3.4 AL or shorter, and the small droplet waveform includes an expansion pulse to expand the volumes of the pressure chambers, a pause period, and a contraction pulse to contract the volumes of the pressure chambers, and the expansion pulse width of the small droplet waveform is 0.8 AL or longer but 1.2 AL or shorter, where AL represents a half of an acoustic resonance period of a pressure wave in the pressure chamber.

Preferably, the drive voltage of the expansion pulse of the large droplet waveform is the same voltage as a drive voltage of the expansion pulse of the small droplet waveform, and a drive voltage of the contraction pulse of the large droplet waveform is the same voltage as a drive voltage of the contraction pulse of the small droplet waveform.

Preferably, the ratio of |Voff| to |Von| is 0.3 or more but 0.7 or less in the large droplet waveform and the small droplet waveform, where Von represents a drive voltage of the expansion pulse, and Voff represents a drive voltages of the contraction pulse.

Preferably, the contraction pulse width of the large droplet waveform is 2 AL, and the expansion pulse width, the pause period, and the contraction pulse width of the small droplet waveform are 1 AL.

Preferably, the large droplet waveform and the small droplet waveform are rectangular waves.

Preferably, the recording head is a recording head of shear mode type in which a partition wall shared by the pressure chambers located next to each other is formed of a piezoelectric material, the recording head of shear mode type that varies the volumes of the pressure chambers by causing shear deformation of the partition wall as the pressure generating unit by applying the drive waveform to a drive electrode formed on the surface of the partition wall, and the shear deformation of the partition wall by the large droplet waveform and the small droplet waveform is caused by a differential waveform between the drive waveform that is applied to the drive electrode facing the inside of the pressure chamber that discharges the ink droplets and the drive waveform that is applied to the drive electrode facing the inside of the pressure chamber that does not discharge the ink droplets and is located next to the pressure chamber that discharges the ink droplets.

Preferably, the drive signal generating unit divides all channels into a plurality of groups by treating three channels located next to one another as one group and applies the drive waveform to the pressure generating unit in such a way as to drive the three channels in each group sequentially by time division.

DESCRIPTION OF THE PREFERRED EMBODIMENTS

The present invention will be described below in detail however the present invention is not limited by the description below.

Figure 1:
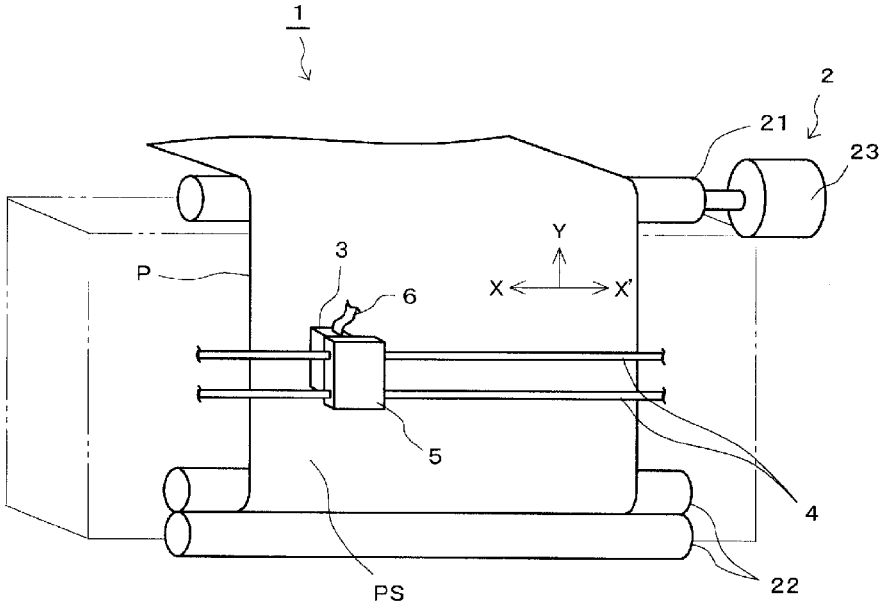
FIG. 1 is a diagram showing a general structure of an ink-jet recording apparatus according to the present invention.

FIG. 1 is a diagram showing a general structure of an ink-jet recording apparatus according to the present invention.

In an ink-jet recording apparatus 1, a recording medium P is held by being sandwiched between a transport roller pair 22 of a transport mechanism 2 and is transported in a Y direction (a subscanning direction) shown in the drawing by a transport roller 21 which is driven and rotated by a transport motor 23.

Between the transport roller 21 and the transport roller pair 22, a recording head 3 is provided in such a way as to face a recording surface PS of the recording medium P. The recording head 3 is disposed and mounted on a carriage 5 in such a way that the nozzle surface thereof faces the recording surface PS of the recording medium P, the carriage 5 provided in such a way that the carriage 5 can reciprocate, by an unillustrated driving unit along guide rails 4 that are put across the recording medium P in the width direction thereof, in an X-X' direction (a main scanning direction) shown in the drawing, the X-X' direction that is virtually perpendicular to the transport direction (the subscanning direction) in which the recording medium P is transported, and the recording head 3 is electrically connected, via a flexible cable 6, to a drive signal generating section 100 (see FIG. 4A) provided in a drive circuit which will be described later.

The recording head 3 moves above the recording surface PS of the recording medium P while scanning the recording surface PS in the X-X' direction shown in the drawing with the movement of the carriage 5 in the main scanning direction and discharges an ink droplet out of a nozzle during this scanning movement. In this way, the recording head 3 records a desired ink-jet image.

Figure 2:
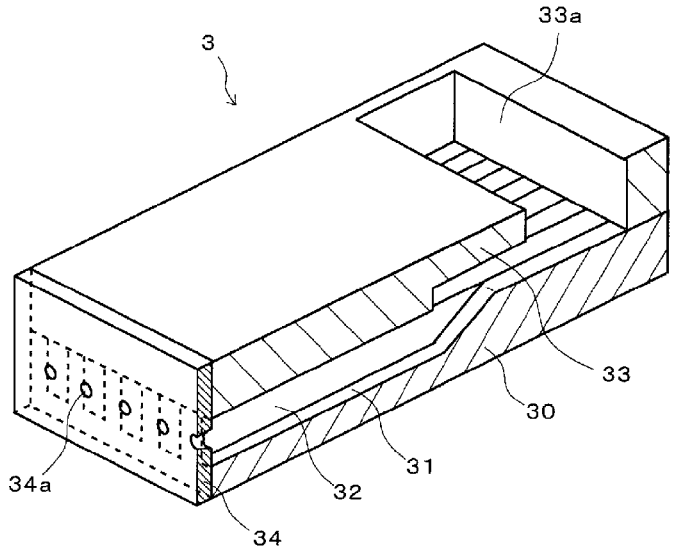
FIGS. 2A and 2B are diagrams showing an example of a recording head, FIG. 2A being a perspective view showing the appearance of the recording head in cross section and FIG. 2B being a sectional view of the recording head viewed from the side thereof.
Figure 2:
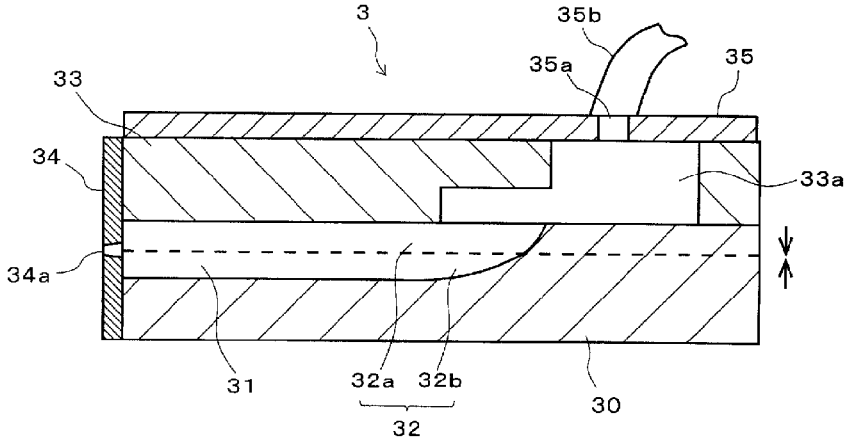

FIGS. 2A and 2B are diagrams showing an example of the recording head 3, FIG. 2A being a perspective view showing the appearance of the recording head 3 in cross section and FIG. 2B being a sectional view of the recording head 3 viewed from the side thereof.

The recording head 3 includes a channel substrate 30. In the channel substrate 30, a large number of narrow groove-shaped channels 31 and partition walls 32 are provided side by side alternately. On a top face of the channel substrate 30, a cover substrate 33 is provided in such a way as to cover all the channels 31 from above. To the end faces of the channel substrate 30 and the cover substrate 33, a nozzle plate 34 is bonded, and the surface of the nozzle plate 34 forms a nozzle surface. An end of each channel 31 communicates with the outside via a nozzle 34*a* formed in the nozzle plate 34.

The other end of each channel 31 becomes gradually shallow with respect to the channel substrate 30 and communicates with a common channel 33*a* which is formed in the cover substrate 33 and shared by the channels 31. The common channel 33*a* is closed with a plate 35, and the common channel 33*a* and the channels 31 are supplied with ink through an ink feed pipe 35*b* via an ink supply port 35*a* formed in the plate 35.

Each partition wall 32 is formed of a piezoelectric material such as PZT which is an electromechanical converting unit. Here, the partition wall 32 in which both an upper wall portion 32*a* and a lower wall portion 32*b* are formed of a piezoelectric material subjected to polarization treatment and the upper wall portion 32*a* and the lower wall portion 32*b* are opposite in polarization direction (indicated by arrows in FIG. 2B) is shown as an example. However, a portion formed of a piezoelectric material subjected to polarization treatment may be only a portion with a reference character 32*a*, for example, and simply has to be at least part of the partition wall 32. The partition walls 32 and the channels 31 are provided side by side alternately. Therefore, one partition wall 32 is shared by the channels 31 and 31 on both sides of the one partition wall 32.

In each channel 31, a drive electrode (not shown in FIGS. 2A and 2B) is formed from the wall surfaces of the partition walls 32 to the bottom face of the channel 31. When a drive pulse of a predetermined voltage is applied to the drive electrodes sandwiching the partition wall 32 from the drive signal generating section provided in the drive circuit which will be described later, the partition wall 32 formed of a piezoelectric material undergoes bending deformation at the bonded surface between the upper wall portion 32*a* and the lower wall portion 32*b*. As a result of the bending deformation of the partition wall 32, a pressure wave is generated in the channel 31, and pressure for discharging ink out of the nozzle 34*a* is provided to the ink in the channel 31. Therefore, the inside of the channel 31 surrounded with the channel substrate 30, the cover substrate 33, and the nozzle plate 34 forms a pressure chamber in the present invention, and the partition wall 32 formed of a piezoelectric material and the drive electrodes on the surface thereof form a pressure generating unit in the present invention.

The drive signal generating section provided in the drive circuit electrically connected to the recording head 3 via the flexible cable 6 generates a drive signal that applies, in one pixel period, at least one drive waveform for discharging an ink droplet. In the present invention, the drive signal generating section is assumed to be capable of generating two types of drive waveform: a large droplet waveform for discharging a large droplet and a small droplet waveform for discharging a small droplet.

Figure 3:
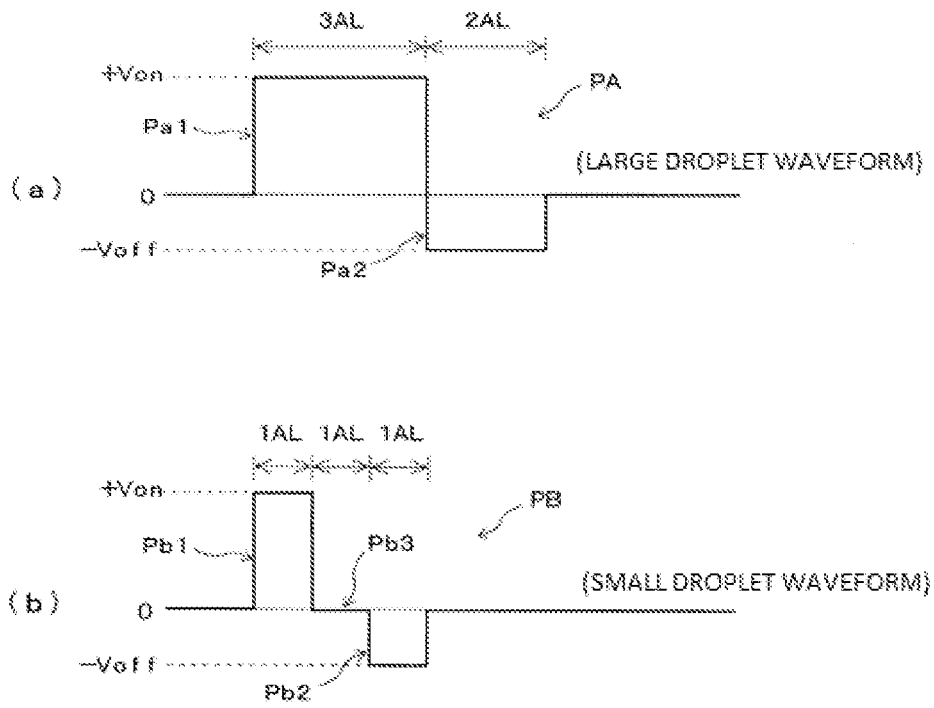
FIG. 3A is a diagram showing a large droplet waveform and FIG. 3B is a diagram showing a small droplet waveform.
Figure 4:
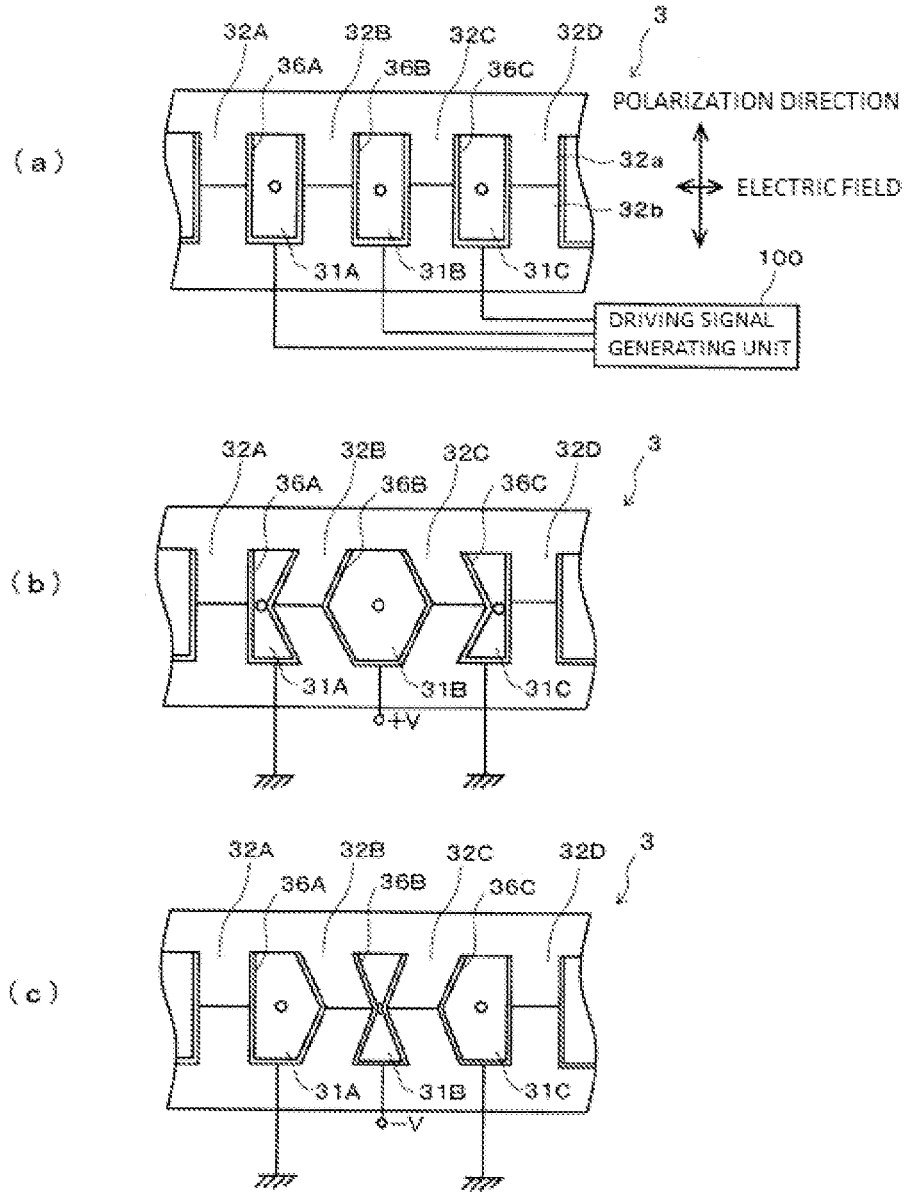
FIGS. 4A to 4C are diagrams describing an ink discharge operation of the recording head performed when the large droplet waveform and the small droplet waveform are applied.

The large droplet waveform and the small droplet waveform will be described by using FIGS. 3A and 3B. In FIGS. 3A and 3B, FIG. 3A depicts the large droplet waveform and FIG. 3B depicts the small droplet waveform. Moreover, an ink discharge operation of the recording head 3 performed when the large droplet waveform and the small droplet waveform are applied will be described by using FIGS. 4A to 4C. FIGS. 4A to 4C show part of a cross section of the recording head 3 cut in a direction perpendicular to the length direction of the channel.

A large droplet waveform PA shown in FIG. 3A is formed of rectangular waves including an expansion pulse Pa1 having a width of 3 AL, the expansion pulse Pa1 that expands the volume of the channel, and a contraction pulse Pa2 having a width of 2 AL, the contraction pulse Pa2 that makes the volume of the channel contract.

Here, AL (acoustic length) corresponds to ½ of an acoustic resonance period of a pressure wave in the channel. The AL is obtained as a pulse width at which the flying speed of an ink droplet becomes maximum when the speed of an ink droplet that is discharged at the time of application of a drive pulse of a rectangular wave to the drive electrode is measured and the pulse width of the rectangular wave is varied by making the voltage value of the rectangular wave constant.

Moreover, the pulse is a rectangular wave of a constant-voltage peak value. When 0V is assumed to be 0% and a peak value voltage is assumed to be 100%, the pulse width is defined as the time between the rising edge 10% from 0V and the falling edge 10% from the peak value voltage.

Furthermore, the rectangular wave refers to a waveform whose rising edge time and falling edge time between 10% and 90% of a voltage fall within ½ of the AL, preferably ¼ of the AL, more preferably 1/10 of the AL.

The expansion pulse Pa1 in the large droplet waveform PA is a pulse that applies a predetermined positive drive voltage +Von to a drive electrode 36B facing the inside of a channel 31B from which an ink droplet is discharged. As shown in FIG. 4A, when no drive pulse is applied to the drive electrodes 36A, 36B, and 36C inside the channels 31A, 31B, and 31C located next to one another, none of the partition walls 32A, 32B, 32C, and 32D is deformed. When the drive electrodes 36A and 36C are grounded and the expansion pulse Pa1 is applied to the drive electrode 36B in a state shown in FIG. 4A, an electric field in a direction perpendicular to the polarization direction of the piezoelectric material forming the partition walls 32B and 32C is generated. As a result, in the partition walls 32B and 32C, shear deformation appears in the bonded surface between the upper partition wall 32*a* and the lower partition wall 32*b*, and, as shown in FIG. 4B, the partition walls 32B and 32C are bent and deformed outwardly and increase the volume of the channel 31B. This bending deformation generates a negative pressure wave in the channel 31B and allows the ink to flow thereinto.

Since the pressure in the channel 31B is inverted once every AL, after a lapse of 3 AL, the inside of the channel 31B becomes a positive pressure. At this time point, the contraction pulse Pa2 is applied to the drive electrode 36B.

The contraction pulse Pa2 is a pulse that applies a negative drive voltage −Voff immediately after the completion of the application of the expansion pulse Pa1 without a pause period. When the drive voltage −Voff is applied to the drive electrode 36B immediately after the expansion pulse Pa1, the partition walls 32B and 32C change from a state shown in FIG. 4B in which the partition walls 32B and 32C are deformed outwardly and are deformed inwardly at once as shown in FIG. 4C. As a result, due to the addition of a positive pressure caused by a sharp falling edge of the expansion pulse Pa1, higher pressure is provided to the inside of the channel 31B and a relatively large ink droplet is discharged out of the nozzle. The contraction pulse Pa2 is returned to a potential of 0 after a lapse of 2 AL, and the deformation of the partition walls 32B and 32C returns to the neutral state of FIG. 4A, whereby the residual pressure wave is cancelled.

The small droplet waveform PB shown in FIG. 3B is formed of rectangular waves including an expansion pulse PM having a width of 1 AL, the expansion pulse Pb1 that expands the volume of the channel, and a contraction pulse Pb2 having a width of 1 AL, the contraction pulse Pb2 that makes the volume of the channel contract, and has, between the expansion pulse Pb1 and the contraction pulse Pb2, a pause period Pb3 allowing a potential of 0 that does not deform the partition wall to continue for 1 AL.

The expansion pulse Pb1 in the small droplet waveform PB is a pulse that applies a predetermined positive drive voltage +Von to the drive electrode 36B facing the inside of the channel 31B from which an ink droplet is discharged. When the drive electrodes 36A and 36C are grounded and the expansion pulse Pb1 is applied to the drive electrode 36B in a state shown in FIG. 4A, as in the case described above, the partition walls 32B and 32C are bent and deformed outwardly as shown in FIG. 4B and increase the volume of the channel 31B. This bending deformation generates a negative pressure wave in the channel 31B and allows the ink to flow thereinto.

Since the pressure in the channel 31B is inverted and becomes a positive pressure after a lapse of 1 AL, when the drive electrode 36B is returned to a potential of 0 at this time point, the partition walls 32B and 32C return to the neutral state shown in FIG. 4A from the expansion position shown in FIG. 4B, and pressure for discharge is provided to the inside of the channel 31B. Since the partition walls 32B and 32C merely return to the neutral state, small pressure as compared to that provided by the large droplet waveform PA is merely provided to the inside of the channel 31B. As a result, a relatively small ink droplet is discharged out of the nozzle.

On the other hand, the contraction pulse Pb2 is a pulse that applies a negative drive voltage −Voff after the completion of the application of the expansion pulse Pb1 after a lapse of the pause period Pb3 that allows a state of a potential of 0 to continue for 1 AL. When the pause period Pb3 of 1 AL is ended after the completion of the application of the expansion pulse Pb1, the partition walls 32B and 32C remain in the neutral state as in FIG. 4A, but the pressure in the channel 31B has become a negative pressure. When the contraction pulse Pb2 is applied to the drive electrode 36B at this time point, the partition walls 32B and 32C are deformed inwardly, a positive pressure is provided to the inside of the channel 31B which is in a negative pressure state, and the partition walls 32B and 32C are then returned to the neutral state after a lapse of 1 AL, whereby the residual pressure wave in the channel 31 is cancelled.

In the above description, the pulse width of the expansion pulse Pa1 in the large droplet waveform PA is assumed to be 3 AL. However, the pulse width of the expansion pulse Pa1 in the large droplet waveform PA simply has to be 2.8 AL or longer but 3.4 AL or shorter. Moreover, the pulse width of the expansion pulse Pb1 in the small droplet waveform PB is also not limited to 1 AL and simply has to be 0.8 AL or longer but 1.2 AL or shorter.

In the present invention, it is possible to provide an ink-jet recording apparatus that can discharge, out of the same nozzle, a large droplet and a small droplet whose droplet speeds are nearly equal by using the same drive voltage by setting the pulse width of the drive waveform for the large droplet and the pulse width of the drive waveform for the small droplet. That is, by adopting a combination of the above-described large droplet waveform PA and the above-described small droplet waveform PB as a combination of a large droplet waveform and a small droplet waveform when ink droplets of different droplet sizes, the ink droplets of which one is larger than the other in size, are discharged out of the same nozzle 34*a* to express gradations in the ink-jet recording apparatus 1, it is possible to make the droplet speed of a large droplet and the droplet speed of a small droplet nearly equal by using the same drive voltage. As a result, displacements of the position in which an ink droplet lands do not become a problem in discharging a large droplet and a small droplet, which eliminates the need to adjust the discharge timing for each droplet size to prevent displacements of the position in which an ink droplet lands as in the conventional technique. This makes it possible to prevent the drive period from being unnecessarily lengthened and perform high-speed printing. Moreover, since the same drive voltage can be used for the large droplet waveform and the small droplet waveform, it is possible to configure the drive signal generating circuit easily.

In the present invention, the large droplet waveform PA and the small droplet waveform PB are preferably rectangular waves as shown in the drawings. In particular, since the recording head 3 of shear mode type described in this embodiment uses pressure wave resonance generated in the channel 31 to discharge an ink droplet out of the nozzle 34*a*, making the phases of the pressure waves uniform through the use of the rectangular wave makes it possible to obtain better pressure wave resonance and discharge an ink droplet more efficiently.

Moreover, since the recording head 3 of shear mode type efficiently uses the pressure wave through the application of a drive waveform formed of rectangular waves, it is possible to keep the drive voltage low. Since a voltage is generally applied to the recording head 3 at all times irrespective of a discharge state or a non-discharge state, a low drive voltage is important in reducing heat generation of the head and discharging an ink droplet with stability.

Furthermore, since the rectangular wave can be generated easily by using a simple digital circuit, the circuit configuration can be simplified as compared to a case in which a trapezoidal wave having an inclined wave is used.

It is preferable that the drive voltage +Von of the expansion pulse Pa1 of the large droplet waveform PA is the same as the drive voltage +Von of the expansion pulse PM of the small droplet waveform PB and the drive voltage −Voff of the contraction pulse Pa2 of the large droplet waveform PA is the same as the drive voltage −Voff of the contraction pulse Pb2 of the small droplet waveform PB. Since one power source is enough for drive signals for a large droplet and a small droplet, it is possible to simplify the configurations of the drive circuit and the control circuit.

Moreover, it is preferable that, in the large droplet waveform PA and the small droplet waveform PB, the ratio of the drive voltage |Voff| of the contraction pulse Pa2 to the drive voltage |Von| of the expansion pulse Pa1 and the ratio of the drive voltage |Voff| of the contraction pulse Pb2 to the drive voltage |Von| of the expansion pulse Pb1 (|Voff|/|Von|) are set at 0.3 or more but 0.7 or less. As a result of the ratio of |Voff| to |Von| being in this range, it is possible to cancel pressure wave reverberations properly and eject a droplet stably in a short period. Furthermore, by appropriately adjusting the ratio of |Voff| to |Von| within this range, it is possible to discharge a large droplet and a small droplet by making the amounts of droplet different in the large droplet waveform PA and the small droplet waveform PB and at the same time further adjust the droplet speeds in such a way that the droplet speeds become nearly equal at the same voltage.

Incidentally, in the present invention, making the droplet speeds nearly equal means that a difference between the droplet speed of one ink droplet of ink droplets of different droplet sizes, the ink droplets of which one is larger than the other in size, and the droplet speed of the other ink droplet is within 1.0 m/s. When the difference in speed is within this range, displacements of the position in which an ink droplet lands, the displacements caused by the difference in speed, are not so obtrusive in an image.

Furthermore, as described in this embodiment, by setting the pulse width of the contraction pulse Pa2 of the large droplet waveform PA at 2 AL and setting the pulse widths of the expansion pulse Pb1, the pause period Pb3, and the contraction pulse Pb2 of the small droplet waveform PB at 1 AL, it is possible to cancel the pressure wave reverberations efficiently and shorten the waveform length of the entire drive waveform. When the waveform length can be shortened, the drive waveform can be applied proportionately in a shorter period of time, which makes this embodiment more favorable in performing high-speed printing.

In the recording head 3 of shear mode type described in this embodiment, the deformation of the partition wall 32 is caused by the difference in voltage applied to two drive electrodes 36 provided in such a way as to sandwich the partition wall 32 formed of a piezoelectric material from either side of the partition wall 32. Therefore, by applying a drive waveform of a positive voltage, by using this difference in voltage, to non-discharge channels on both sides of a discharge channel performing discharge of an ink droplet in place of applying a drive waveform of a negative voltage to the discharge channel and using a differential waveform thereof, it is also possible to perform driving in the same manner as that described above.

Figure 5:
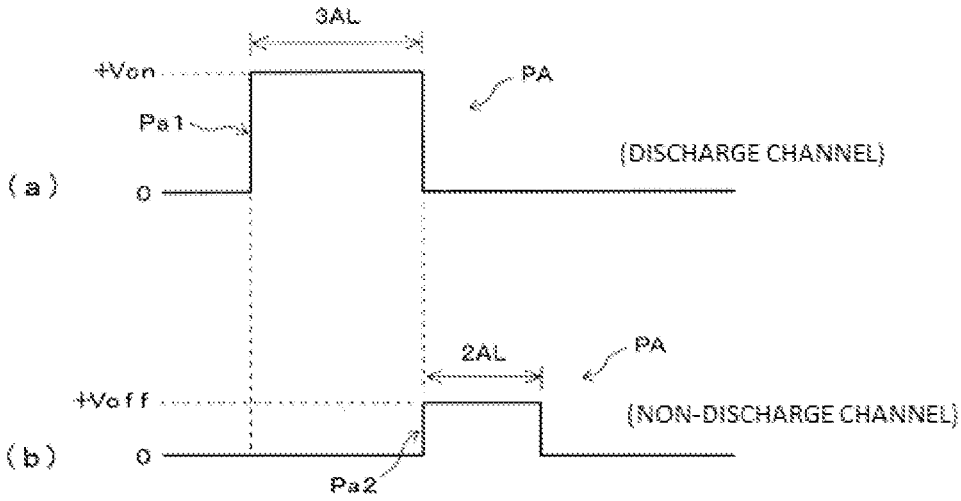
FIGS. 5A and 5B are diagrams showing the large droplet waveform when driving is performed by using a differential waveform.

For example, when the channel 31B shown in FIGS. 4A to 4C is assumed to be a discharge channel performing discharge of an ink droplet and the large droplet waveform PA is applied to the channel 31B, only the expansion pulse Pa1 of a positive voltage (+Von) in the large droplet waveform PA as shown in FIG. 5A may be applied to the drive electrode 36B facing the inside of the channel 31B, and, when the contraction pulse Pa2 is applied, the drive electrode 36B may be grounded and the contraction pulse Pa2 of a positive voltage (+Voff) as shown in FIG. 5B may be applied to the drive electrodes 36A and 36C facing the insides of the channels 31A and 31C, respectively, which are non-discharge channels on both sides of the discharge channel. As a result of the application of the contraction pulse Pa2, the partition walls 32B and 32C are deformed outwardly in the channels 31A and 31C, and therefore the channel 31B is deformed in such a way as to make the volume thereof contract as shown in FIG. 4C.

Figure 6:
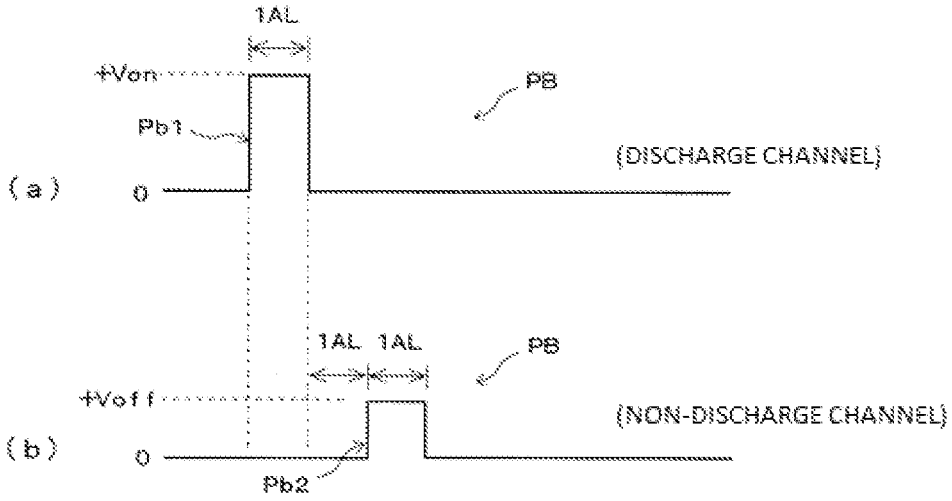
FIGS. 6A and 6B are diagrams showing the small droplet waveform when driving is performed by using a differential waveform.

Moreover, likewise, when the small droplet waveform PB is applied to the channel 31B, only the expansion pulse PM of a positive voltage (+Von) in the small droplet waveform PB as shown in FIG. 6A may be applied to the drive electrode 36B facing the inside of the channel 31B, in the subsequent pause period Pb3, the drive electrodes 36A, 36B, and 36C may be grounded, and, when the contraction pulse Pb2 is applied, the contraction pulse Pb2 of a positive voltage (+Voff) as shown in FIG. 6B may be applied to the drive electrodes 36A and 36C facing the insides of the channels 31A and 31C, respectively, which are non-discharge channels on both sides of the discharge channel.

As described above, by making a differential waveform of the drive waveform applied to the drive electrode 36 facing the inside of a non-discharge channel adjacent to a discharge channel discharging an ink droplet cause shear deformation of the partition wall 32 by the contraction pulse Pa2 of the large droplet waveform PA and the contraction pulse Pb2 of the small droplet waveform PB, the drive waveform for discharging a large ink droplet and a small ink droplet can be formed only of a positive voltage (+Von, +Voff). This makes it possible to simplify the drive circuit.

As in this embodiment, when the recording head 3 in which a plurality of channels 31 partitioned by the partition walls 32, at least part of which is formed of a piezoelectric material, are provided side by side is driven, if the partition walls 32 of one channel 31 perform a discharge operation, the channels 31 on both sides of that channel 31 are affected by this operation. Therefore, a 3-cycle driving method is performed by which all the channels 31 are divided into a plurality of groups by treating three channels of the channels 31, the three channels located next to one another, as one group and three channels of each group are sequentially driven by time division.

A discharge operation by the 3-cycle driving method will be described by using FIGS. 7A to 7C to FIGS. 9A to 9C.

In the recording head 3 when the 3-cycle driving method is performed, channels 31 on every two lines are collectively treated as one group, and all the channels 31 are divided into three groups: A, B, and C (referred to as an A phase, a B phase, and a C phase). Here, of these channels 31, nine channels 31: A1, B1, C1, A2, B2, C2, A3, B3, and C3 which are located next to one another will be described. Moreover, a timing chart of drive waveforms that are applied to the drive electrodes (which are not shown in FIGS. 7A to 7C to FIGS. 9A to 9C) inside the channels 31 of the A phase, the B phase, and the C phase at this time is shown in FIG. 10. Here, a case in which the large droplet waveform PA shown in FIGS. 5A and 5B and the small droplet waveform PB shown in FIGS. 6A and 6B are used and an ink droplet is discharged in the order of a B-phase channel (a large droplet)→a C-phase channel (a small droplet)→an A-phase channel (a large droplet) will be described.

Incidentally, here, the large droplet waveform PA and the small droplet waveform PB are generated by selecting one of a PLSTM0 (GND) waveform, a PLSTM1 waveform, and a PLSTM2 waveform which are shown in FIG. 10 at the rising edge of a pulse division signal, and driving is performed by a differential waveform of a drive waveform that is applied to two drive electrodes sandwiching the partition wall 32. The PLSTM0 waveform is a waveform maintaining a potential of 0 for grounding, the PLSTM1 waveform is a waveform in which a waveform having a pulse width of 3 AL, the waveform of +Von corresponding to the expansion pulse Pa1 of the large droplet waveform PA, is repeated with a pause period of 3 AL being placed between the waveforms having a pulse width of 3 AL, and the PLSTM2 waveform is a waveform in which a waveform having a pulse width of 2 AL, the waveform of +Voff corresponding to the contraction pulse Pa2 of the large droplet waveform PA, is repeated with a pause period of 4 AL being placed between the waveforms having a pulse width of 2 AL. The PLSTM2 waveform is repeated at a time point at which the PLSTM2 waveform rises in synchronization with the falling edge of the PLSTM1 waveform. This causes discharge from the A-phase channel, discharge from the B-phase channel, and discharge from the C-phase channel to be sequentially performed at intervals of 6 AL.

Moreover, the pulse division signal is a timing signal for generating the small droplet waveform PB by dividing the PLSTM1 waveform and the PLSTM2 waveform and is formed of a total of four signals in a period in which a pulse selection gate signal defining the driving timing of the A-phase, the B-phase, and the C-phase channels has risen, the four signals: a first pulse division signal d1 that rises in synchronization with the rising edge of the PLSTM1 waveform signal, second and third pulse division signals d2 and d3 that rise at intervals of 1 AL after the first pulse division signal d1, and a fourth pulse division signal d4 that rises after a lapse of 2 AL from the rising edge of the third pulse division signal d3.

Figure 7:
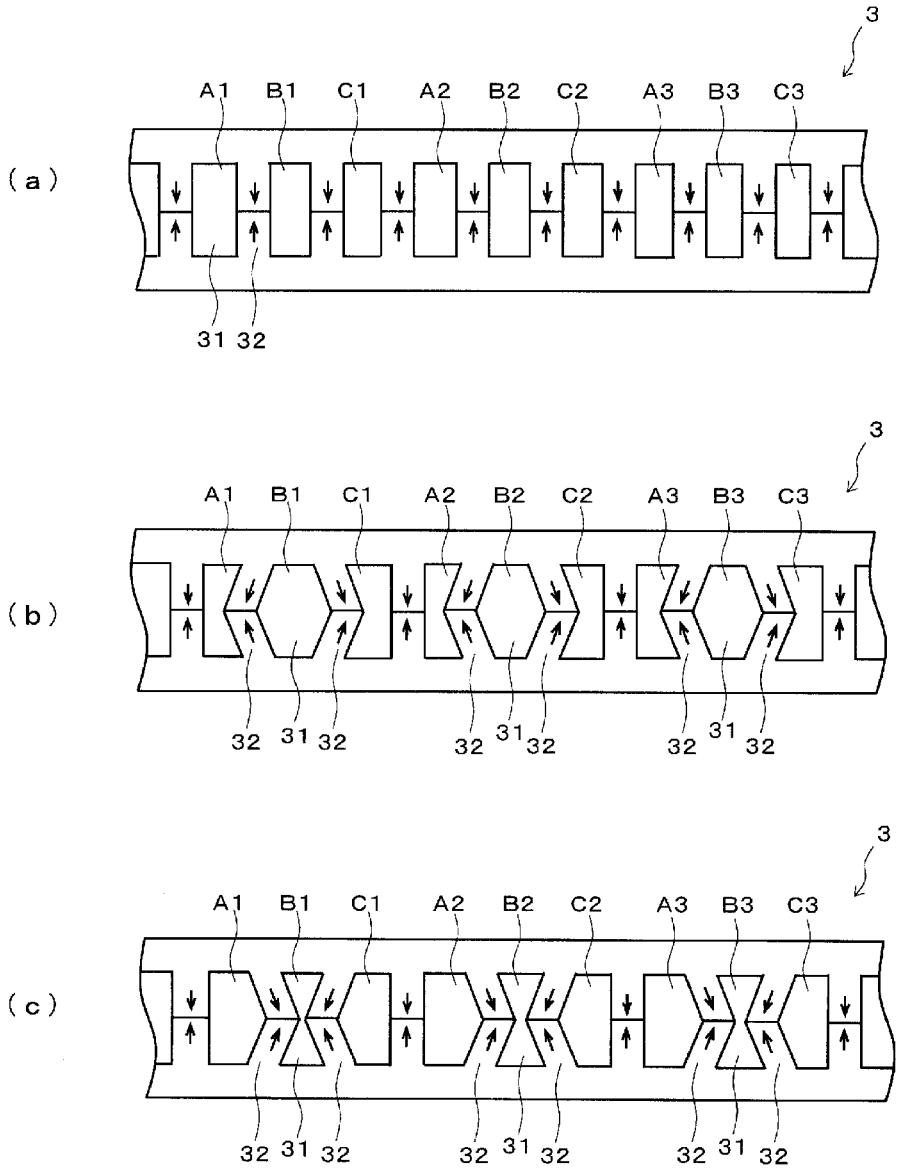
FIGS. 7A to 7C are diagrams describing a discharge operation at the time of 3-cycle driving.

FIGS. 7A to 7C depict a discharge operation performed when a large droplet is discharged from the B-phase channel. First, from the neutral state of FIG. 7A, after the pulse selection gate signal for the B-phase channel rises, in synchronization with the rising edge of the first pulse division signal d1, the PLSTM2 waveform is selected and applied to the A-phase channels (A1, A2, A3) and the C-phase channels (C1, C2, C3) which are non-discharge channels and the PLSTM1 waveform is selected and applied to the B-phase channels (B1, B2, B3) which are discharge channels as shown in FIG. 10. As a result, the partition walls of each B-phase channel are deformed outwardly as shown in FIG. 7B, and the volume of each B-phase channel expands.

After a lapse of 3 AL, at a time point at which the expansion pulse Pa1 included in the PLSTM1 waveform falls, the PLSTM2 waveform applied to the A-phase channels and the C-phase channels rises, and the contraction pulse Pa2 of 2 AL, the contraction pulse Pa2 of the large droplet waveform PA, is applied to the A-phase channels and the C-phase channels. As a result, the partition walls of each B-phase channel are deformed inwardly as shown in FIG. 7C and the volume of each B-phase channel contracts at once, and a large droplet is discharged out of each of the nozzles of the B-phase channels.

After the contraction pulse Pa2 continues for 2 AL, the potentials of the A-phase channels, the B-phase channels, and the C-phase channels become 0, and all the channels return to the neutral state as in FIG. 7A and cancel the residual pressure wave.

Figure 8:
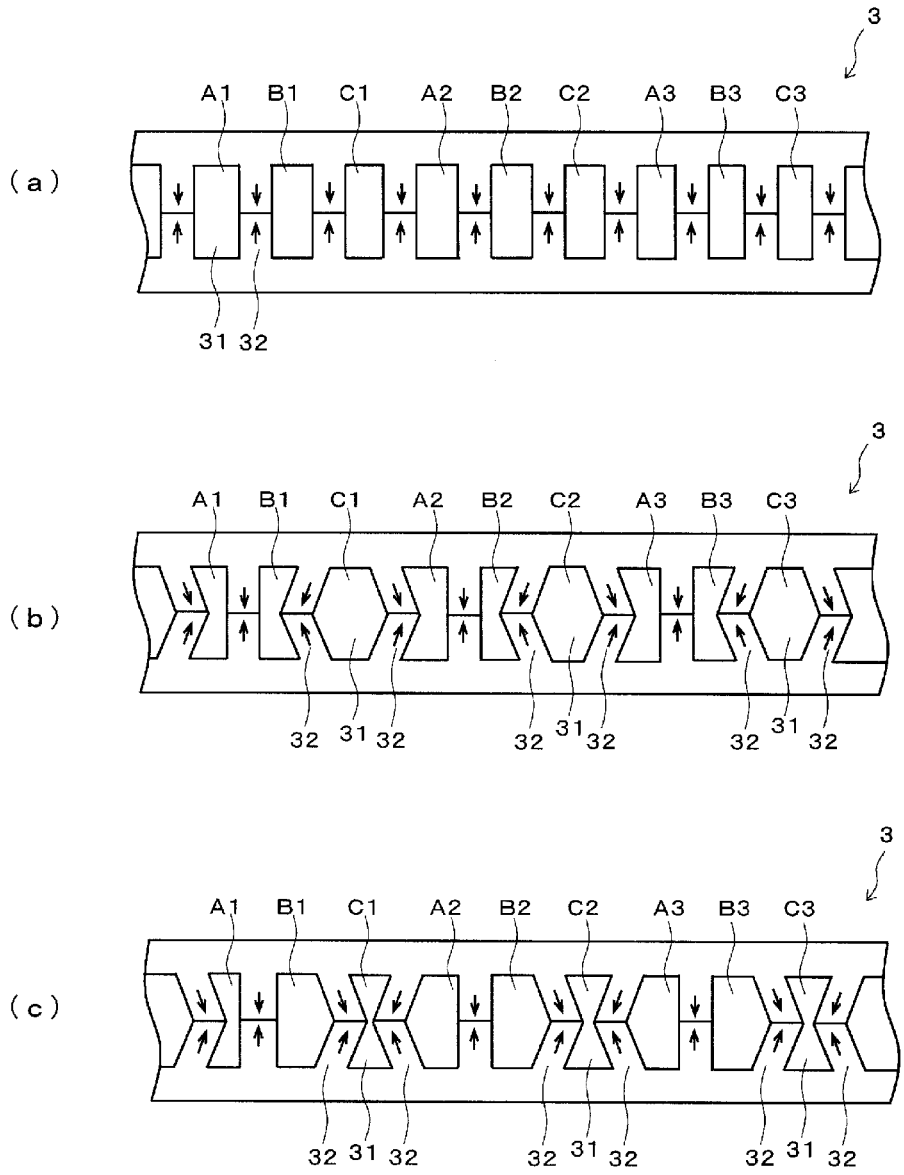
FIGS. 8A to 8C are diagrams describing a discharge operation at the time of 3-cycle driving.

Next, FIGS. 8A to 8C depict a discharge operation performed when a small droplet is discharged from the C phase channel. First, from the neutral state of FIG. 8A, after the pulse selection gate signal for the C-phase channel rises, in synchronization with the rising edge of the first pulse division signal d1, the PLSTM2 waveform is selected and applied to the A-phase channels and the B-phase channels which are non-discharge channels and the PLSTM0 waveform is selected and applied to the C-phase channels which are discharge channels as shown in FIG. 10. At this point, all the channels maintain the neutral state of FIG. 8A.

Then, in synchronization with the rising edge of the second pulse division signal d2, the PLSTM1 waveform is selected and applied only to the C-phase channels. As a result, the partition walls of each B-phase channel are deformed outwardly as shown in FIG. 8B, and the volume of each B-phase channel expands.

After the application of the PLSTM1 waveform to the C-phase channels continues for 1 AL, when the PLSTM0 waveform is selected and applied again to the C-phase channels at the rising edge of the third pulse division signal d3, all the channels return to the neutral state of FIG. 8A. As a result, since the partition walls of each C-phase channel contract and return from the expanded state of FIG. 8B to the neutral state, a small droplet is discharged out of each of the nozzles of the C-phase channels.

After a lapse of 1 AL from the falling edge of the PLSTM1 waveform applied to the C-phase channels, the PLSTM2 waveform applied to the A-phase channels and the B-phase channels rises. As a result, the partition walls of each C-phase channel contract inwardly as shown in FIG. 8C from the neutral state of FIG. 8A. Then, when the PLSTM2 waveform is selected and applied to the C-phase channels in synchronization with the rising edge of the fourth pulse division signal d4, the state enters a state in which the same positive voltage +Voff is applied to all of the A-phase channels, the B-phase channels, and the C-phase channels. This eliminates a difference in voltage among the partition walls, and all the channels return to the neutral state of FIG. 8A and cancel the residual pressure wave.

Figure 9:
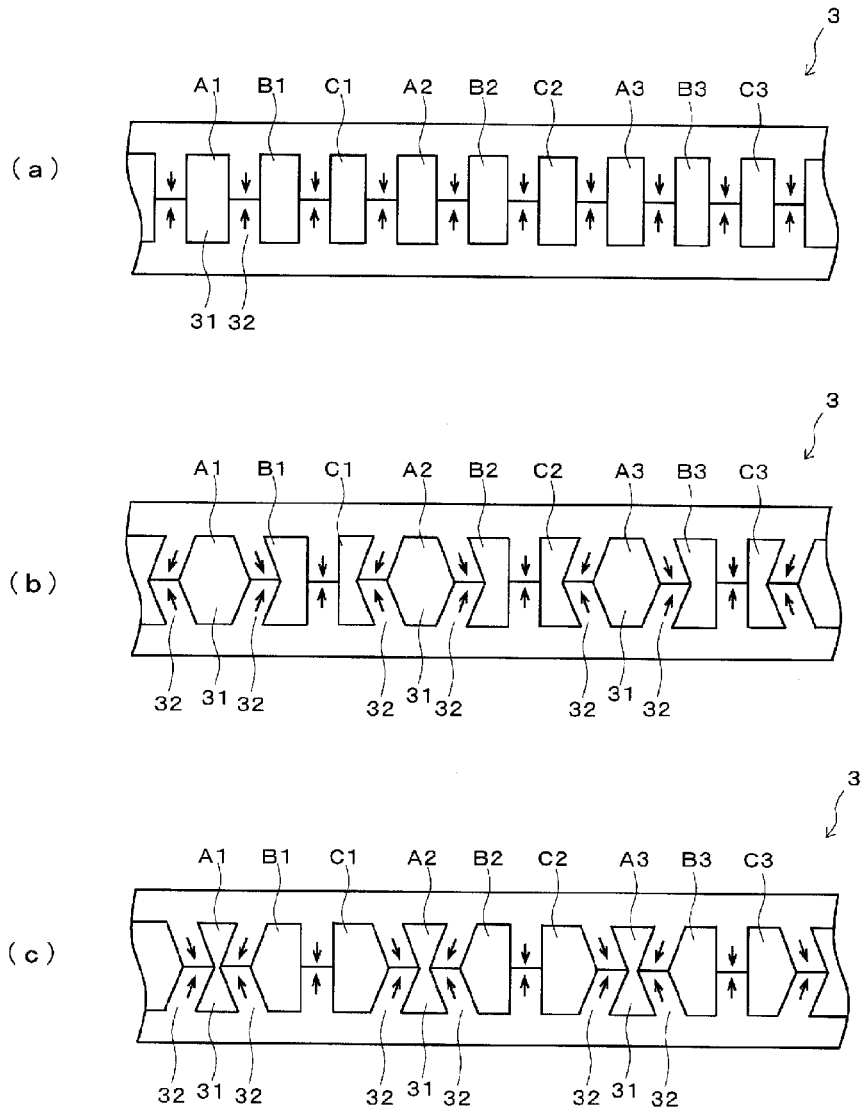
FIGS. 9A to 9C are diagrams describing a discharge operation at the time of 3-cycle driving.
Figure 10:
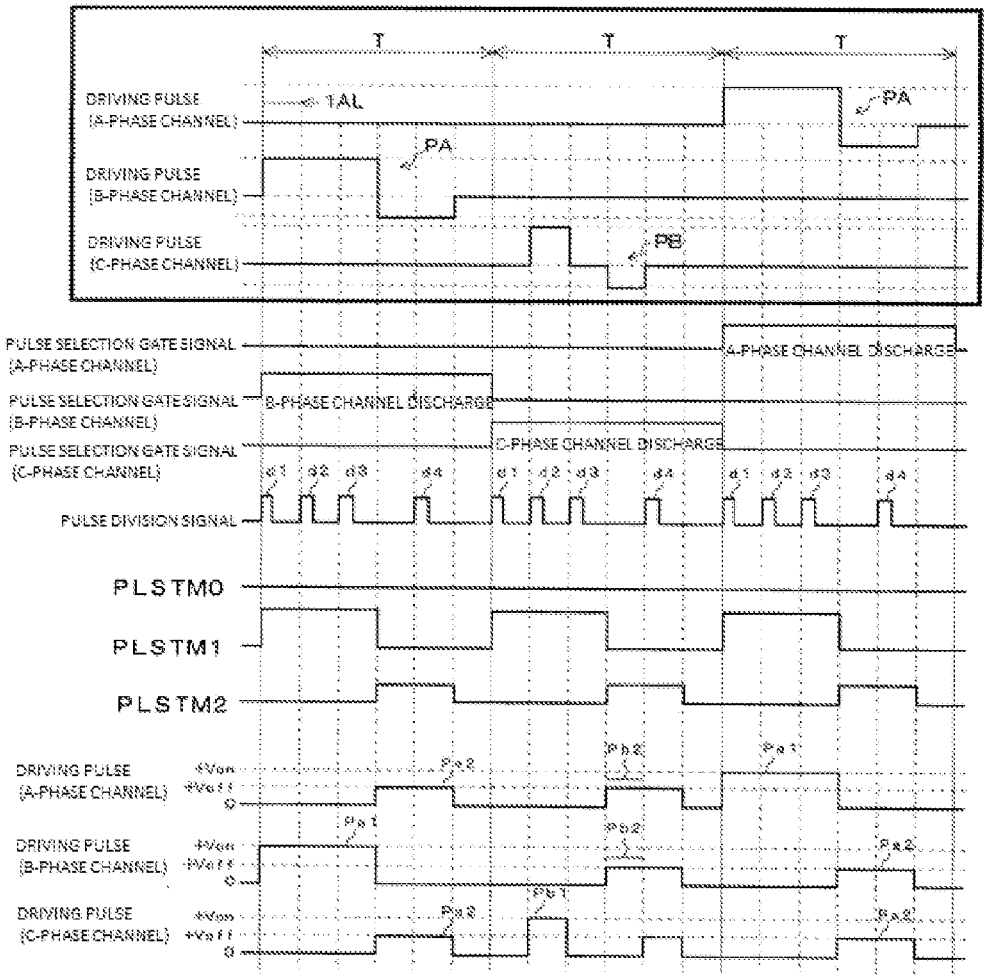
FIG. 10 is a timing chart of drive waveforms that are applied at the time of 3-cycle driving.

FIGS. 9A to 9C depict a discharge operation performed when a large droplet is discharged from the A-phase channel. First, from the neutral state of FIG. 9A, after the pulse selection gate signal for the A-phase channel rises, in synchronization with the rising edge of the first pulse division signal d1, the PLSTM2 waveform is selected and applied to the B-phase channels and the C-phase channels which are non-discharge channels and the PLSTM1 waveform is selected and applied to the A-phase channels which are discharge channels as shown in FIG. 10. As a result, the partition walls of each A-phase channel are deformed outwardly as shown in FIG. 9B, and the volume of each A-phase channel expands.

After a lapse of 3 AL, at a time point at which the expansion pulse Pa1 included in the PLSTM1 waveform falls, the PLSTM2 waveform applied to the B-phase channels and the C-phase channels rises, and the contraction pulse Pa2 of 2 AL, the contraction pulse Pa2 of the large droplet waveform PA, is applied to the B-phase channels and the C-phase channels. As a result, the partition walls of each A-phase channel are deformed inwardly as shown in FIG. 9C and the volume of each A-phase channel contracts at once, and a large droplet is discharged out of each of the nozzles of the A-phase channels.

After the contraction pulse Pa2 continues for 2 AL, the potentials of the A-phase channels, the B-phase channels, and the C-phase channels become 0, and all the channels return to the neutral state as in FIG. 9A and cancel the residual pressure wave.

In the 3-cycle driving method by which driving is performed in the manner described above, only by appropriately selecting one of three waveforms: the PLSTM0 waveform, the PLSTM1 waveform, and the PLSTM2 waveform and applying the selected waveform in each of the A phase, the B phase, and the C phase, it is possible to generate the large droplet waveform PA and the small droplet waveform PB and apply the generated waveform to the channels in each phase. This makes it extremely easy to generate the drive waveform for discharging a large droplet and a small droplet and makes it possible to simplify the drive circuit and reduce costs.

Figure 11:
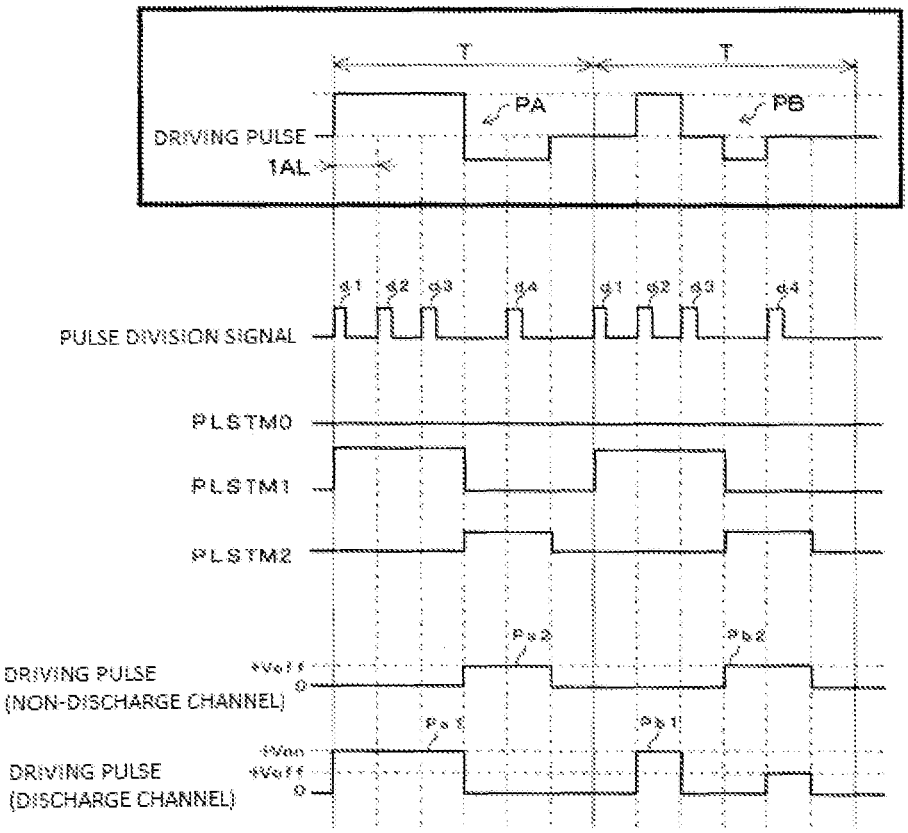
FIG. 11 is a timing chart of drive waveforms that are applied at the time of independent driving.

The recording head 3 of shear mode type described in this embodiment can be formed as a recording head of independent driving type in which a discharge channel that always discharges an ink droplet and a non-discharge channel that does not discharge an ink droplet are disposed alternately. A timing chart of drive waveforms that are applied to the discharge channel and the non-discharge channel when the recording head of independent driving type is adopted is shown in FIG. 11.

Also in this case, as in the case of FIG. 10, only by appropriately selecting one of three waveforms: the PLSTM0 waveform, the PLSTM1 waveform, and the PLSTM2 waveform and applying the selected waveform, it is possible to generate the large droplet waveform PA and the small droplet waveform PB and perform driving by using a differential waveform. That is, by always selecting the PLSTM2 waveform to be applied to the non-discharge channel and selecting the PLSTM1 waveform to be applied to the discharge channel or selecting the PLSTM0 waveform, the PLSTM1 waveform, or the PLSTM2 waveform in synchronization with the pulse division signal, it is possible to select discharge of a large droplet or discharge of a small droplet. This makes it possible to simplify the drive circuit.

EXAMPLES

Hereinafter, the advantages of the present invention will be illustrated based on examples.

(1) The Relationship Between the Drive Pulse Width and the Droplet Speed and the Amount of Droplet As a recording head, a recording head of shear mode type shown in FIGS. 2A and 2B, the recording head in which a nozzle pitch was 300 dpi, the nozzle number was 512, the nozzle diameter was 23 μm, and AL was 2.4 μs, was used, and the recording head was driven by independent driving by setting the drive frequency at 40 kHz.

Figure 12:
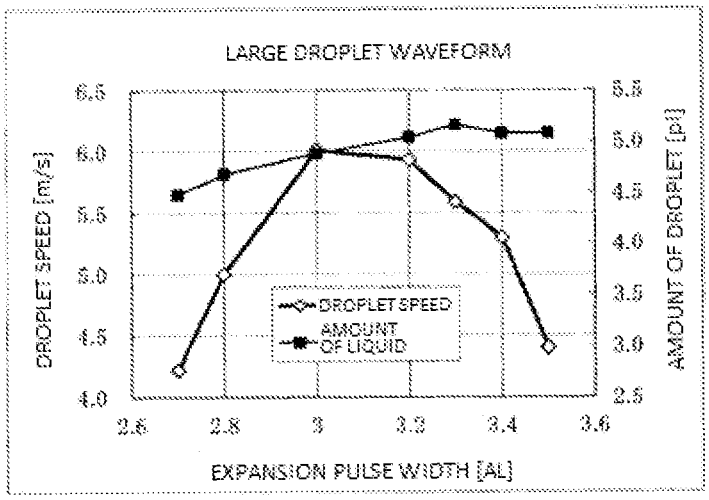
FIG. 12 is a graph showing the relationship between the amount of droplet and the droplet speed when the pulse width of the large droplet waveform is varied.

The drive voltages Von and Voff of the large droplet waveform applied to the recording head were set at 17.7 V and 8.9 V, respectively (|Voff|/|Von|=0.5), and the contraction pulse width was set at 4.8 μs (2 AL). The amount of droplet and the droplet speed of a droplet that flew 1 mm from the nozzle surface, which were observed when the pulse width of the large droplet waveform was varied, were measured. The results are shown in Table 1 and FIG. 12.

TABLE 1

| Expansion Pulse Width (AL) | Droplet Speed (m/s) | Amount of Droplet (pl) | Remarks |
|---|---|---|---|
| 2.7 | 4.2 | 4.5 | |
| 2.8 | 5.0 | 4.7 | Present Invention |
| 3.0 | 6.0 | 4.9 | Present Invention |
| 3.2 | 5.9 | 5.0 | Present Invention |
| 3.3 | 5.6 | 5.2 | Present Invention |
| 3.4 | 5.3 | 5.1 | Present Invention |
| 3.5 | 4.4 | 5.1 | |

Figure 13:
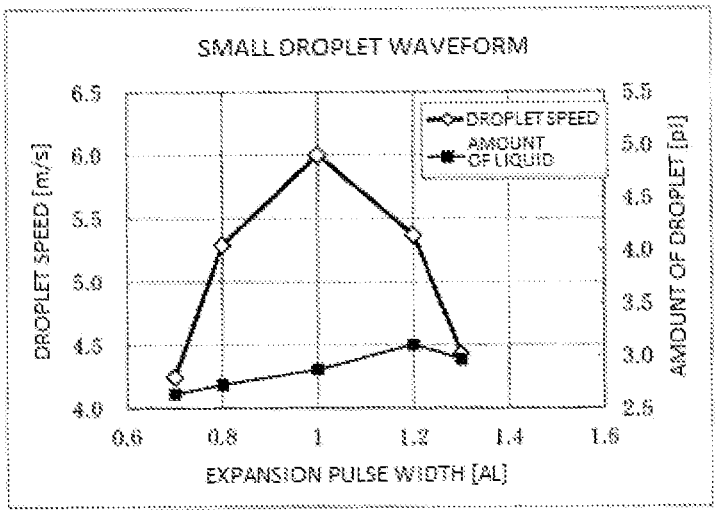
FIG. 13 is a graph showing the relationship between the amount of droplet and the droplet speed when the pulse width of the small droplet waveform is varied.

Moreover, the drive voltages Von and Voff of the small droplet waveform applied to the recording head were set at 17.7 V and 8.9 V, respectively (|Voff|/|Von|=0.5), and the pause period and the contraction pulse width were set at 2.4 μs (1 AL). The amount of droplet and the droplet speed of a droplet that flew 1 mm from the nozzle surface, which were observed when the pulse width of the small droplet waveform was varied, were measured. The results are shown in Table 2 and FIG. 13.

TABLE 2

| Expansion Pulse Width (AL) | Droplet Speed (m/s) | Amount of Droplet (pl) | Remarks |
|---|---|---|---|
| 0.7 | 4.3 | 2.6 | |
| 0.8 | 5.3 | 2.7 | Present Invention |
| 1.0 | 6.0 | 2.9 | Present Invention |
| 1.2 | 5.4 | 3.1 | Present Invention |
| 1.3 | 4.4 | 3.0 | |

As described above, when the expansion pulse width of the large droplet waveform was set at 2.8 AL or longer but 3.4 AL or shorter and the expansion pulse width of the small droplet waveform was set at 0.8 AL or longer but 1.2 AL or shorter, it was possible to achieve a fast droplet speed and make the amount of droplet of a large droplet different from the amount of droplet of a small droplet, and a difference in droplet speed became 1.0 m/s or less, making it possible to eject a droplet adequately. Moreover, when the expansion pulse width of the large droplet waveform and the expansion pulse width of the small droplet waveform are set in the above-described ranges, even when the AL value of the recording head varies, variations in the droplet speed can be reduced, making it possible to suppress variations in ejection characteristics due to individual differences among the heads.

(2) The Relationship Between the Drive Voltage Ratio and the Droplet Speed and the Amount of Droplet As a recording head, a recording head of shear mode type shown in FIGS. 2A and 2B, the recording head in which a nozzle pitch was 300 dpi, the nozzle number was 512, the nozzle diameter was 23 μm, and AL was 2.4 μs, was used, and the recording head was driven by independent driving by setting the drive frequency at 40 kHz.

Figure 14:
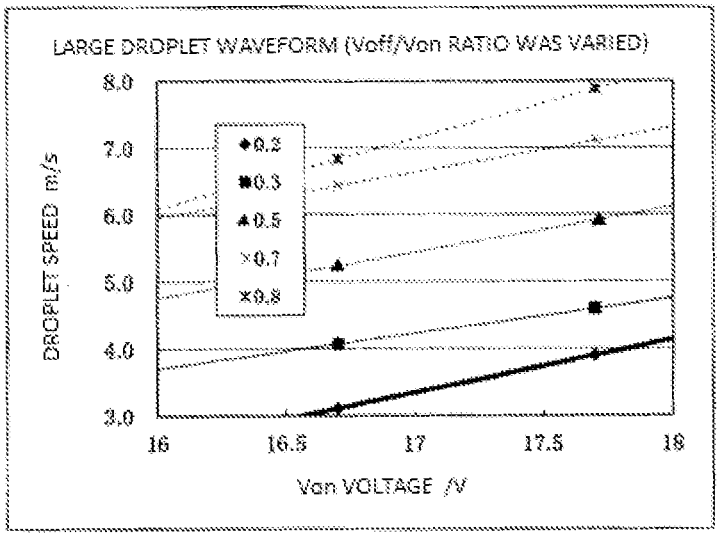
FIG. 14 is a graph showing the relationship between the drive voltage ratio of the large droplet waveform and the droplet speed when the drive voltage ratio of the large droplet waveform is varied.

The droplet speed of a droplet that flew 1 mm from the nozzle surface when the expansion pulse width and the contraction pulse width of the large droplet waveform were set at 7.2 μs (3 AL) and 4.8 μs (2 AL), respectively, and the drive voltage ratio (|Voff|/|Von|) was varied was measured. The results are shown in Table 3 and FIG. 14.

TABLE 3

| Voltage | Von Voltage | | |
|---|---|---|---|
| Ratio | 16.7 V | 17.7 V | Remarks |
| 0.2 | 3.1 m/s | 3.9 m/s | |
| 0.3 | 4.1 m/s | 4.6 m/s | Present Invention |
| 0.5 | 5.2 m/s | 5.9 m/s | Present Invention |
| 0.7 | 6.4 m/s | 7.1 m/s | Present Invention |
| 0.8 | 6.8 m/s | 7.9 m/s | |

Figure 15:
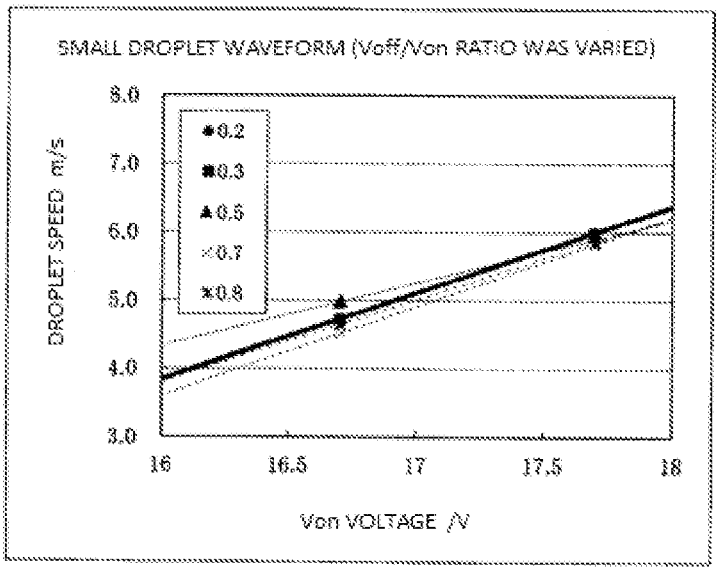
FIG. 15 is a graph showing the relationship between the drive voltage ratio of the small droplet waveform and the droplet speed when the drive voltage ratio of the small droplet waveform is varied.

Moreover, the droplet speed of a droplet that flew 1 mm from the nozzle surface when the expansion pulse width, the pause period, and the contraction pulse width of the small droplet waveform were set at 2.4 μs (1 AL) and the drive voltage ratio (|Voff|/|Von|) was varied was measured. The results are shown in Table 4 and FIG. 15.

TABLE 4

| Voltage | Von Voltage | | |
|---|---|---|---|
| Ratio | 16.7 V | 17.7 V | Remarks |
| 0.2 | 4.7 m/s | 6.0 m/s | |
| 0.3 | 4.7 m/s | 6.0 m/s | Present Invention |
| 0.5 | 5.0 m/s | 5.9 m/s | Present Invention |
| 0.7 | 4.5 m/s | 5.8 m/s | Present Invention |
| 0.8 | 4.7 m/s | 5.9 m/s | |

As described above, in the case of the small droplet waveform, there is little change in the droplet speed at the same Von voltage even when the drive voltage ratio is varied. On the other hand, in the case of the large droplet waveform, even at the same Von voltage, the droplet speed changes greatly when the drive voltage ratio is varied. This reveals that, even when the Von voltage is constant, by appropriately adjusting the drive voltage ratio on the large droplet waveform side, it is possible to make an adjustment in such a way that the droplet speed when the large droplet waveform is applied becomes nearly equal to the droplet speed when the small droplet waveform is applied.

Next, the amount of droplet when the Von voltage of the large droplet waveform and the small droplet waveform was fixed at 16.7 V or 17.7 V and the drive voltage ratio (|Voff|/|Von|) was varied was measured.

Figure 16:
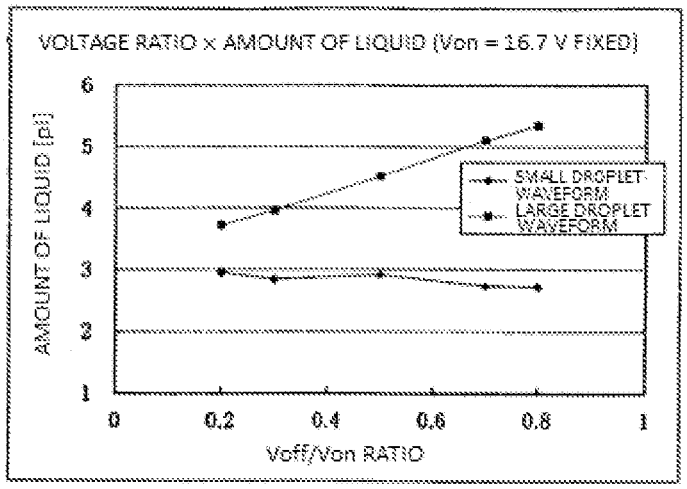
FIG. 16 is a graph showing the relationship between the drive voltage ratio and the amount of droplet when the Von voltage of the large droplet waveform and the small droplet waveform is fixed at 16.7 V.

The results obtained when Von is 16.7 V are shown in Table 5 and FIG. 16.

TABLE 5

| Voltage Ratio | Von = 16.7 V Small Droplet | Large Droplet | Remarks |
|---|---|---|---|
| 0.2 | 3.0 pl | 3.7 pl | |
| 0.3 | 2.8 pl | 4.0 pl | Present Invention |
| 0.5 | 2.9 pl | 4.5 pl | Present Invention |
| 0.7 | 2.7 pl | 5.1 pl | Present Invention |
| 0.8 | 2.7 pl | 5.4 pl | |

Figure 17:
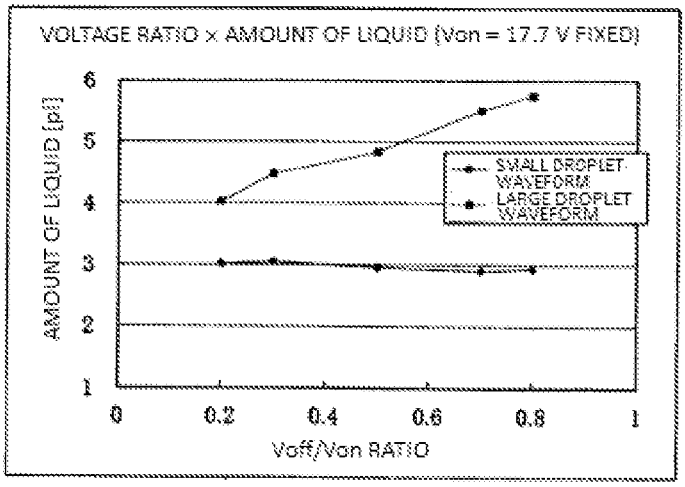
FIG. 17 is a graph showing the relationship between the drive voltage ratio and the amount of droplet when the Von voltage of the large droplet waveform and the small droplet waveform is fixed at 17.7 V.

Moreover, the results obtained when Von is 17.7 V are shown in Table 6 and FIG. 17.

TABLE 6

| Voltage Ratio | Von = 17.7 V Small Droplet | Large Droplet | Remarks |
|---|---|---|---|
| 0.2 | 3.0 pl | 4.0 pl | |
| 0.3 | 3.0 pl | 4.5 pl | Present Invention |
| 0.5 | 3.0 pl | 4.8 pl | Present Invention |
| 0.7 | 2.9 pl | 5.5 pl | Present Invention |
| 0.8 | 2.9 pl | 5.8 pl | |

As described above, as is clear from Table 5 (FIG. 16) and Table 6 (FIG. 17), by adjusting the drive voltage ratio, it is possible to make the amount of droplet when the large droplet waveform is applied different from the amount of droplet when the small droplet waveform is applied. In particular, it is possible to make an adjustment in such a way that the droplet speeds become nearly equal while maintaining a state in which the amount of droplet when the large droplet waveform is applied is 1.4 times the amount of droplet when the small droplet waveform is applied.

(3) The Relationship Between the Voltage Ratio and the Droplet Speed

As a recording head, a recording head of shear mode type shown in FIGS. 2A and 2B, the recording head in which a nozzle pitch was 300 dpi, the nozzle number was 512, the nozzle diameter was 25 μm, and AL was 2.1 μs, was used, and the recording head was driven by independent driving by setting the drive frequency at 45 kHz.

The droplet speed of a droplet that flew 1 mm from the nozzle surface when the expansion pulse width and the contraction pulse width of the large droplet waveform were set at 6.3 μs (3 AL) and 4.2 μs (2 AL), respectively, and the Von voltage was fixed at 16 V was measured.

Figure 18:
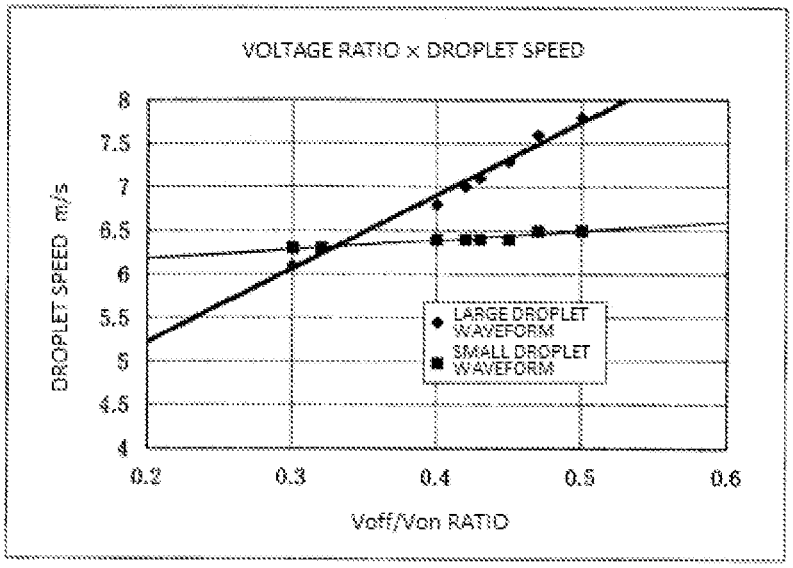
FIG. 18 is a graph showing the relationship between the drive voltage ratio of the large droplet waveform and the small droplet waveform and the droplet speed.

Moreover, the droplet speed of a droplet that flew 1 mm from the nozzle surface when the expansion pulse width, the pause period, and the contraction pulse width of the small droplet waveform were set at 2.1 μs (1 AL) and the Von voltage was fixed at 16 V was measured. The results are shown in Table 7 and FIG. 18.

TABLE 7

| Voltage Ratio | Large Droplet Waveform | Small Droplet Waveform |
|---|---|---|
| 0.5 | 7.8 m/s | 6.5 m/s |
| 0.47 | 7.6 m/s | 6.5 m/s |
| 0.45 | 7.3 m/s | 6.4 m/s |

TABLE 7-continued

| Voltage Ratio | Large Droplet Waveform | Small Droplet Waveform |
|---|---|---|
| 0.43 | 7.1 m/s | 6.4 m/s |
| 0.42 | 7.0 m/s | 6.4 m/s |
| 0.4 | 6.8 m/s | 6.4 m/s |
| 0.32 | 6.3 m/s | 6.3 m/s |
| 0.3 | 6.1 m/s | 6.3 m/s |

As described above, as is clear from Table 7 (FIG. 18), also in the recording head that is different from the recording head used in Table 3 and Table 4, the droplet speed when the small droplet waveform is applied and the droplet speed when the large droplet waveform is applied sometimes coincide with each other at the same voltage ratio (|Voff|/|Von|) when the Von voltages are set at the same voltage.

(4) 3-Cycle Driving

As a recording head, a recording head of shear mode type shown in FIGS. 2A and 2B, the recording head in which a nozzle pitch was 300 dpi, the nozzle number was 512, the nozzle diameter was 24 μm, and AL was 3.3 μs, was used, and the recording head was driven by 3-cycle driving by setting the drive frequency at 10 kHz and setting the Von voltage and the Voff voltage at 15.5 V and 7.8 V, respectively (|Voff|/|Von|=0.5).

When the expansion pulse width and the contraction pulse width of the large droplet waveform were set at 9.9 μs (3 AL) and 6.6 μs (2 AL), respectively, the droplet speed was 6.1 m/s and the amount of droplet was 6.7 pl. On the other hand, when the expansion pulse width, the pause period, and the contraction pulse width of the small droplet waveform were set at 3.3 μs (1 AL), the droplet speed was 6.0 m/s and the amount of droplet was 4.2 pl.

As described above, even when a large droplet and a small droplet were discharged by 3-cycle driving, the droplet speeds could be made nearly equal.

(5) Independent Driving

As a recording head, a recording head of shear mode type shown in FIGS. 2A and 2B, the recording head in which a nozzle pitch was 300 dpi, the nozzle number was 512, the nozzle diameter was 23 μm, and AL was 2.4 μs, was used, and the recording head was driven by independent driving by setting the drive frequency at 40 kHz and setting the Von voltage and the Voff voltage at 17.9 V and 9 V, respectively (|Voff|/|Von|=0.5).

When the expansion pulse width and the contraction pulse width of the large droplet waveform were set at 7.2 μs (3 AL) and 4.8 μs (2 AL), respectively, the droplet speed was 6.0 m/s and the amount of droplet was 4.9 pl. On the other hand, when the expansion pulse width, the pause period, and the contraction pulse width of the small droplet waveform were set at 2.4 μs (1 AL), the droplet speed was 6.0 m/s and the amount of droplet was 2.9 pl.

Moreover, as a recording head, a recording head of shear mode type shown in FIGS. 2A and 2B, the recording head in which a nozzle pitch was 300 dpi, the nozzle number was 512, the nozzle diameter was 25 μm, and AL was 2.1 μs, was used, and the recording head was driven by independent driving by setting the drive frequency at 45 kHz and setting the Von voltage and the Voff voltage at 16 V and 6.5 V, respectively (|Voff|/|Von|=0.4).

When the expansion pulse width and the contraction pulse width of the large droplet waveform were set at 6.3 μs (3 AL) and 4.2 μs (2 AL), respectively, the droplet speed was 6.8 m/s and the amount of droplet was 5.2 pl. On the other hand, when the expansion pulse width, the pause period, and the contraction pulse width of the small droplet waveform were set at 2.1 μs (1 AL), the droplet speed was 6.4 m/s and the amount of droplet was 2.8 pl.

As described above, even when a large droplet and a small droplet were discharged by independent driving, the droplet speeds could be made nearly equal.

(6) Conclusion

As described above, according to the present invention, by setting the expansion pulse width of the large droplet waveform at 2.8 AL or longer but 3.4 AL or shorter and setting the expansion pulse width of the small droplet waveform at 0.8 AL or longer but 1.2 AL or shorter, it is possible to make the amounts of droplet different while making the droplet speeds nearly equal and discharge a large droplet and a small droplet.

Moreover, in the case of the small droplet waveform, there is little change in the droplet speed at the same Von voltage even when the drive voltage ratio is varied. However, in the case of the large droplet waveform, the droplet speed can be changed even at the same Von voltage by varying the drive voltage ratio.

Based on those described above, in the present invention, by varying the drive voltage ratio of the large droplet waveform, it is possible to make an adjustment in such a way that the droplet speeds become nearly equal while making the amount of droplet of a large droplet different from the amount of droplet of a small droplet.

The entire disclosure of Japanese Patent Application No. 2012-58003, filed on Mar. 14, 2012 including description, claims, drawing, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

The invention claimed is:

1. An ink-jet recording apparatus comprising:

a recording head that includes (i) a plurality of nozzles which discharge ink droplets, (ii) pressure chambers, each of the pressure chamber communicating with the nozzles, respectively, and (iii) a pressure generating unit which causes ink in each of the pressure chambers to be discharged out of the nozzles by varying volumes of the pressure chambers, respectively; and a drive signal generating unit that generates a drive signal for applying, in one pixel period, at least one drive waveform for causing the ink droplets to be discharged, wherein the ink-jet recording apparatus is configured to operate the pressure generating unit by applying the drive signal to the pressure generating unit to make the pressure generating unit cause the ink droplets to be discharged out of the nozzles, and wherein:

the drive signal generating unit is configured to be capable of generating a large droplet waveform and a small droplet waveform, the large droplet waveform includes an expansion pulse to expand the volumes of the pressure chambers and a contraction pulse to contract the volumes of the pressure chambers, and an expansion pulse width of the large droplet waveform is not shorter than 2.8 AL and not longer than 3.4 AL, and the small droplet waveform includes, in this order, (i) an expansion pulse to expand the volumes of the pressure chambers, (ii) a pause period, and (iii) a contraction pulse to contract the volumes of the pressure chambers, and an expansion pulse width of the small droplet waveform is not shorter than 0.8 AL and not longer than 1.2 AL, where AL represents a half of an acoustic resonance period of a pressure wave in the pressure chamber.

2. The ink-jet recording apparatus according to claim 1, wherein a drive voltage of the expansion pulse of the large droplet waveform is the same voltage as a drive voltage of the expansion pulse of the small droplet waveform, and a drive voltage of the contraction pulse of the large droplet waveform is the same voltage as a drive voltage of the contraction pulse of the small droplet waveform.

3. The ink-jet recording apparatus according to claim 1, wherein a ratio of |Voff|to|Von| is not less than 0.3 and not more than 0.7 in the large droplet waveform and the small droplet waveform, where Von represents a drive voltage of the expansion pulse, and Voff represents a drive voltages of the contraction pulse.

4. The ink-jet recording apparatus according to claim 1, wherein a contraction pulse width of the large droplet waveform is 2 AL, and the expansion pulse width, the pause period, and a contraction pulse width of the small droplet waveform are each 1 AL.

5. The ink-jet recording apparatus according to claim 1, wherein the large droplet waveform and the small droplet waveform are rectangular waves.

6. The ink-jet recording apparatus according to claim 1, wherein:

the recording head is a recording head of shear mode type including a partition wall formed of a piezoelectric material that is shared by adjacent pressure chambers, and drive electrodes formed on surfaces of the partition wall, the pressure generating unit comprising the partition wall and the drive electrodes, the recording head of shear mode type that varies the volumes of the pressure chambers by causing shear deformation of the partition wall by applying the drive waveform to the drive electrodes formed on the surfaces of the partition wall, and the shear deformation of the partition wall by the large droplet waveform and the small droplet waveform is caused by a differential waveform between the drive waveform that is applied to the drive electrode facing an inside of the pressure chamber that discharges the ink droplets and the drive waveform that is applied to the drive electrode facing an inside of the pressure chamber that does not discharge the ink droplets and is located next to the pressure chamber that discharges the ink droplets.

7. The ink-jet recording apparatus according to claim 1, wherein the drive signal generating unit divides all pressure chambers into a plurality of groups by treating three pressure chambers located next to one another as one group and applies the drive waveform to the pressure generating unit in such a way as to drive the three pressure chambers in each group sequentially by time division.

* * * * *